US008641025B2

(12) United States Patent
Himmelsbach et al.

(10) Patent No.: US 8,641,025 B2
(45) Date of Patent: Feb. 4, 2014

(54) METHOD FOR THE SUPPORT OF A ROTATING WORKPIECE DURING GRINDING AND A HYDRODYNAMIC STEADY REST

(75) Inventors: Georg Himmelsbach, Haslach (DE); Hubert Mueller, Nordrach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 489 days.

(21) Appl. No.: 12/667,987

(22) PCT Filed: Jul. 3, 2008

(86) PCT No.: PCT/EP2008/058585

§ 371 (c)(1),
(2), (4) Date: Jan. 6, 2010

(87) PCT Pub. No.: WO2009/007301

PCT Pub. Date: Jan. 15, 2009

(65) Prior Publication Data

US 2010/0181712 A1 Jul. 22, 2010

(30) Foreign Application Priority Data

Jul. 6, 2007 (DE) ..... 10 2007 031 512

(51) Int. Cl.
*B23Q 3/08* (2006.01)

(52) U.S. Cl.
USPC ..... 269/35; 269/309

(58) Field of Classification Search
USPC ..... 269/35, 309–310, 21, 900, 267; 29/281.1, 271
See application file for complete search history.

(56) References Cited

U.S. PATENT DOCUMENTS

| | | | | | |
|---|---|---|---|---|---|
| 2,738,650 | A * | 3/1956 | McAfee | 91/511 |
| 2,911,987 | A * | 11/1959 | Wayman | 137/51 |
| 3,554,079 | A * | 1/1971 | Hunkeler et al. | 409/9 |
| 3,566,894 | A * | 3/1971 | Satoh | 137/54 |
| 4,174,724 | A * | 11/1979 | Tuzson | 137/56 |
| 4,385,434 | A * | 5/1983 | Zehnpfennig et al. | 29/281.1 |
| 4,663,892 | A * | 5/1987 | Smith | 451/49 |
| 5,311,704 | A * | 5/1994 | Barton, II et al. | 451/10 |
| 6,149,503 | A | 11/2000 | Laycock | |
| 6,273,785 | B1 * | 8/2001 | Mulroy et al. | 451/28 |
| 6,935,786 | B2 | 8/2005 | Hirano et al. | |
| 7,686,287 | B2 * | 3/2010 | Dixon et al. | 269/75 |
| 2006/0123612 | A1 * | 6/2006 | Wiseman et al. | 29/281.1 |
| 2010/0059914 | A1 * | 3/2010 | Cherala et al. | 269/21 |
| 2010/0219574 | A1 * | 9/2010 | Stark | 269/309 |

FOREIGN PATENT DOCUMENTS

| | | |
|---|---|---|
| DE | 1 627 998 | 11/1970 |
| DE | 1 752 520 | 12/1970 |
| DE | 1 577 369 | 7/1971 |
| DE | 26 19 133 | 1/1977 |

(Continued)

*Primary Examiner* — Brent W Herring
(74) *Attorney, Agent, or Firm* — Jordan and Hamburg LLP

(57) ABSTRACT

In a method for the hydrodynamic support and centering of a rotating workpiece during grinding and a steady rest usable for this purpose the bearing to be supported is impinged upon by a contact pressure which changes in accordance with rotational speed from a minimum pressure when the shaft is started from a standstill, to a maximum value during the processing rotational speed. The steady rest has an opening of a transversebore in a central bore receiving a supply line by which a lubricant can be supplied as hydraulic fluid to the bearing. The method is particularly suitable for the processing of camshafts and crankshafts.

9 Claims, 6 Drawing Sheets

(56) References Cited

FOREIGN PATENT DOCUMENTS

| | | | |
|---|---|---|---|
| DE | 32 40 332 | | 5/1984 |
| DE | 34 37 113 | | 3/1986 |
| DE | 39 10 576 | | 7/1990 |
| DE | 102 18 930 | | 11/2003 |
| DE | 102 32 394 | | 7/2004 |
| DE | 602 10 187 | | 12/2006 |
| EP | 0 306 326 | | 3/1989 |
| EP | 1 298 335 | | 4/2003 |
| JP | 03163213 A | * | 7/1991 |

* cited by examiner

METHOD FOR THE SUPPORT OF A ROTATING WORKPIECE DURING GRINDING AND A HYDRODYNAMIC STEADY REST

BACKGROUND OF THE INVENTION

The invention relates to a method for supporting and hydrodynamically centering a rotating workpiece during machining on a workpiece machine/grinding machine, and relates to a steady for performing said method.

Usually centering steadies are used for supporting rotating workpieces during grinding. This support is necessary in order to prevent the workpiece from sagging from the effect of the forces of the grinding wheel that are acting in the transverse direction. For this, support bodies are used that contact the workpiece at a plurality of locations and center it with respect to the axis of rotation. The support is generally provided in a self-centering manner by means of three support elements arranged on the circumference of the bearing to be supported. Such steadies are known, for example, from DE-OS 1 577 369.

The support elements for such steadies are normally coated with CBN (cubic centered boron nitride) or PCD (polycrystalline diamond) at the contact points, to reduce wear and visible running tracks. Since the steadies contact the workpiece at the support elements, a so-called running track necessarily occurs at the support point. The running track is based on a smoothing of the surface roughness at points of contact and is optically visible. This change in the surface quality can potentially have an unfavorable influence on the lubricating film in the bearing. In addition, the supporting portion changes in this area of the bearing. Although any change in the dimensions of the bearing point in the area of the running track is frequently only minor, such a change is frequently no longer acceptable given constantly increasing technical demands on the bearing points. The finish grinding of the bearing point that is therefore necessary after using the steady leads to an undesired increase in grinding time and thus in unit costs.

Moreover, a steady that supports the bearing at three locations suffers from the disadvantage that a short-wave non-circularity that has occurred on the bearing point during machining is also formed on the bearing point and in at least some cases cannot be compensated. These two effects cannot be entirely prevented with the known steadies.

Another variant of steadies are so-called hydrostatic steadies, such as are described in DE-OS 1 627 998 and EP 1 298 335 B1 (German translation: DE 602 10 187 T2). With these steadies, the bearing point is supported by a hydrostatic bearing in which a plurality of hydrostatic pockets distributed around the interior circumference of the bearing are actuated using a fluid that is under pressure. This produces a hydrostatic pressure on the bearing point of the shaft, and this pressure supports and centers the shaft. The fluid pressure is adjusted using a regulating device. A particular disadvantage of this type of steady is that the bearing point cannot be machined while being supported because it is entirely surrounded by the steady. This variant also requires a special design for the support shell, with support pockets and relief grooves, which leads to complex and expensive production.

According to DE 102 32 394 B4 from Erwin Junker Maschinenfabrik GmbH (Applicant), for supporting a rotating workpiece, at least one cushioned body that can be actuated using a pressure fluid is positioned against the workpiece from the side disposed opposite the grinding wheel.

The positioning force can be influenced pneumatically or hydraulically. In certain embodiments a fluid can be added between the cushioned body and the workpiece as a pressure means and lubricant. One disadvantage of this type of support is the single-sided support of the workpiece and the complex design.

The underlying object of the invention is to provide a method for supporting a rotating workpiece during machining, which method avoids the disadvantages of the prior art, and to propose a cost-effective steady that is suitable for performing the method.

SUMMARY OF THE INVENTION

This object is attained using a method having the features cited in claim 1 and using a steady in accordance with either of claim 10 or 11. Additional embodiments of the method are provided in claims 2 through 9 and additional embodiments of the steady are provided in claims 12 through 16.

In accordance with an embodiment of a method according to the invention, the axial region of the workpiece that is to be supported is subjected to pressure that acts radially, that is, on the longitudinal axis of the workpiece and thus on the axis of rotation, and the magnitude of which is controlled between a minimum value and a maximum value as a function of the current rotational speed. Specifically this means that the bearing point of the rotating workpiece, for example, a gear shaft, crankshaft, or camshaft, the bearing point being used for providing for support by means of a steady, is actuated in the steady with a contact pressure that can be controlled. The fluid that is used for producing the contact pressure can be, for instance, the cooling oil or lubrication oil used for grinding. This fluid is preferably supplied to the annular gap via a transverse bore (i.e., a bore that is laterally offset with respect to the axis of the steady), the aperture of which opens into the annular gap between steady and bearing point, and forms a hydrodynamic bearing there. This bearing, which is under pressure at the machining rotational speed, supports the workpiece on all sides in the region of the steady. This prevents direct contact between the steady and the surface of the bearing so that no running track can occur. In addition, it has also surprisingly been demonstrated that pressure-dependent, dynamic centering of the workpiece occurs in the region of the bearing point.

When the method is performed, the pressure of the fluid that is supplied to the annular gap via the opening in the transverse bore is controlled between a minimum value, when the workpiece is started up, and a maximum value. In accordance with the invention, the maximum value occurs when the machining rotational speed is attained, and is essentially maintained at this level during machining It is within the framework of the invention that when the workpiece is ground at a variable machining rotational speed, the fluid pressure follows the current machining rotational speed. However, it is also possible to keep the pressure constant in this case. What is crucial is that the corresponding pressure range covered is essentially higher than the fluid pressure when start-up begins.

The minimum value of the pressure results from the requirement for a closed lubricating film in the annular gap between the steady and the bearing point of the workpiece. This means that the minimum value should be greater than 0. However, a value of zero should also be included as the minimum value for the pressure. What is crucial during operation is that the fluid pressure builds up quickly at start-up. This lubricating film must be ensured as soon as possible upon the workpiece starting up from being at rest, because otherwise undesired direct contact occurs between the metal parts. However, the pressure must not be too high at the beginning, because this would act on the bearing point in a non-symmetrical manner, which would also lead to contact between the aforesaid parts. In addition, fluid pressure that is too high on the bearing point inhibits the start-up of the workpiece because it acts like a brake since the workpiece at the affected bearing point can then have contact with the bearing shell in the bearing shell at the side of the bearing shell opposite the supply bore.

During this start-up process in which the shaft attains an increasing rotational speed, the fluid pressure is increased according to the current rotational speed. In the framework of the invention, this can occur continuously or at appropriately selected stages. According to one aspect of the invention, the increase in pressure is controlled linearly as the rotational speed of the driven workpiece increases. In one modification, a non-linear, progressive increase in the fluid pressure with the speed may also be advantageous. This is implemented, for instance, in a manner such that at the beginning of the start-up process there is a relatively slow increase in the fluid pressure, while at a higher rotational speed, i.e., near machining rotational speed, there is a relatively sharp increase in the fluid pressure. Controlling the fluid pressure in this manner permits especially rapid start-up, at the beginning of accelation of the workpiece, while the high pressure that is required for dynamically centering the workpiece during machining is essentially not brought entirely to bear until near the end of the start-up. In certain cases it can be useful to let the increase in pressure occur especially rapidly at first, for instance, when an especially rapid and reliable use of the dynamic bearing of the workpiece is desired due to the material properties of the workpiece.

The maximum value of the fluid pressure can be determined using tests. Inter alia, this maximum value is a function of the rotational speed of the workpiece during machining and of the fluid used for producing pressure. Tests have demonstrated that an increase in the fluid pressure in the annular gap leads to a pressure-dependent improvement in the centering of the workpiece with respect to its axis of rotation. Concentricities in the range of a few μm can be attained at pressures for instance in a range between 5 and 150 bar. The concentricity increases at a given rotational speed as pressure increases. In the framework of the invention, "maximum value" shall be construed to be the maximum pressure that is required for each machining status, at which pressure the grinding work for the workpiece then occurs at the machining rotational speed.

Using the inventive procedure results in the advantages that the rotational speed of the shaft to be ground ramps up rapidly and smoothly from idle to machining rotational speed, and that during grinding there is very precise centering and support for the shaft at the bearing point. These advantages do not exist for the prior art cited in the foregoing, because the prior art is merely concerned with the behavior of the steadies at machining rotational speed and do not consider the start-up process. In addition, the effect of the very precise centering of the shaft that is rotating at high rotational speed using an optimum, high fluid pressure at the bearing point is not mentioned. However, high fluid pressure, per se, would lead to problems during start-up. Only the invention has realized that, for optimum machining of shafts with a short machining time, it is advantageous to control the fluid pressure in the steady as a function of the current rotational speed of the workpiece.

A control device that responds to the current rotational speed of the workpiece and controls or regulates the fluid pressure accordingly is provided to control the fluid pressure in accordance with the invention. It makes practical sense to use a CNC control for the grinding machine for this purpose, since this CNC is already present. The control acts on valves that make it possible to adjust the fluid pressure in the annular gap, for example, by changing the flow. It is possible to adjust the pressure by regulating the flow amount with nothing further required, because fluid is always exiting via the annular gap, which is open laterally.

In the design of the invention, the control includes at least one sensor that detects the current fluid pressure and compares it to a pre-specified, rotational speed-dependent value. For this purpose, the control device preferably has an electronic computer that is programmed appropriately and that has input devices, processors, memory, and other necessary devices.

The fluid pressure is preferably controlled such that it also follows a variation in the rotational speed of the workpiece that is due to the machining of the workpiece during individual or a plurality of rotations. Thus, the term "maximum value of the fluid pressure" should not be considered as an absolutely sharply defined value Rather, it can have a certain bandwidth that is however slight relative to the highest value. What is crucial is that the fluid pressure during machining is significantly higher than when the workpiece starts up and that it is maintained in the high pressure range during machining.

A further embodiment of the invention relates to a structural form of steady that differs from the steady in accordance with another described embodiment herein, and that is similar to that in DE 102 32 394 B4 from Applicant. The steady according to the embodiment of the invention has at least one bearing region that can be pressed against the workpiece and that can be actuated with a fluid pressure. The steady according to the embodiment also has means for supplying a fluid that is acting as a lubricant between the workpiece and the bearing region. In this case, "bearing region" means a part of a steady that surrounds the workpiece to be supported only in a limited segment of its circumference. Such steadies can have one or a plurality of bearing regions. In accordance with DE 102 32 394 B4, the bearing regions are embodied as cushioned bodies, made of an elastic solid material or an elastic outer skin filled with an elastic pressure medium, that are preferably placed against the roller to be ground in the circumferential region opposite the grinding wheel. With this structural form of the inventive steady, both the contact pressure of the bearing region and the fluid pressure of the fluid that is used as a lubricant and cooling means, essentially independent of the contact pressure in the bearing region, are pre-specified. In accordance with the invention, the fluid pressure is controlled as a function of the rotational speed, as has already been described with respect to steadies in accordance with the other embodiment of the invention. The fluid pressure when the workpiece starts up from idle is initially low and increases as the rotational speed increases until it reaches its maximum value at machining rotational speed. The minimum value of the fluid pressure must not be lower than the contact pressure in the bearing region, however, because otherwise there would be no lubrication. The contact pressure in the bearing region per se remains essentially constant, and can be pre-specified by the control, for example, via pneumatic or hydraulic means.

In accordance with yet another embodiment, the at least one bearing region is provided with a supply line, the workpiece-side opening of which permits fluid to enter between the bearing region and the workpiece. If a plurality of bearing regions are provided, in accordance with a further embodiment, they should preferably be arranged concentric with the workpiece to be supported and coaxial with its axis of rotation.

The method in accordance with the invention, and the associated steadies, are employed for machining shaft-like parts. Workpieces can be, for example, gear shafts, camshafts, or crankshafts. The embodiments illustrated in the following can be used for supporting all possible shafts. The details are determined by the technical aspects of and grinding technology for each specific case.

The steadies according to the invention can also be used in a grinding machine, the grinding station of which is improved with regard to loading and unloading the workpieces. This structural variant is equipped with a rotary indexing table that carries two support apparatuses. The support apparatuses alternate traveling into the machining position. Thus, the next workpiece can be ready for the next clamping in a matter of seconds, and there is no need to wait additional workpiece exchange time. The workpiece is loaded and unloaded on the side of the rotary indexing table that faces away from the grinding wheel while the other workpiece is being machined.

For finish-machined bearing points for shaft parts, camshafts, crankshafts, etc., divided bearing blocks can be used for steadies. With such bearing blocks, it is possible to receive the shaft parts in exactly the same manner when grinding the contours, cams, connecting rod bearings, etc. Moreover, no visible running tracks remain on the shaft at the support point for the steady.

Using this approach, not only is it possible to precisely reproduce the recent employment conditions for the shaft-like workpieces, but the best dimensional, shape, and position tolerances are also attained during machining.

With respect to the different diameters of the bearing points to be supported, the bearing shells/bearing blocks must be adapted to the support diameter, this preferably occurs using suitable, workpiece-independent exchangeable parts when retrofitting the workpiece machine.

The methods for supporting and dynamically centering a rotating workpiece and the steady in accordance with the invention are described in the following using the figures.

DETAILED DESCRIPTION OF THE INVENTION

Figure 1:
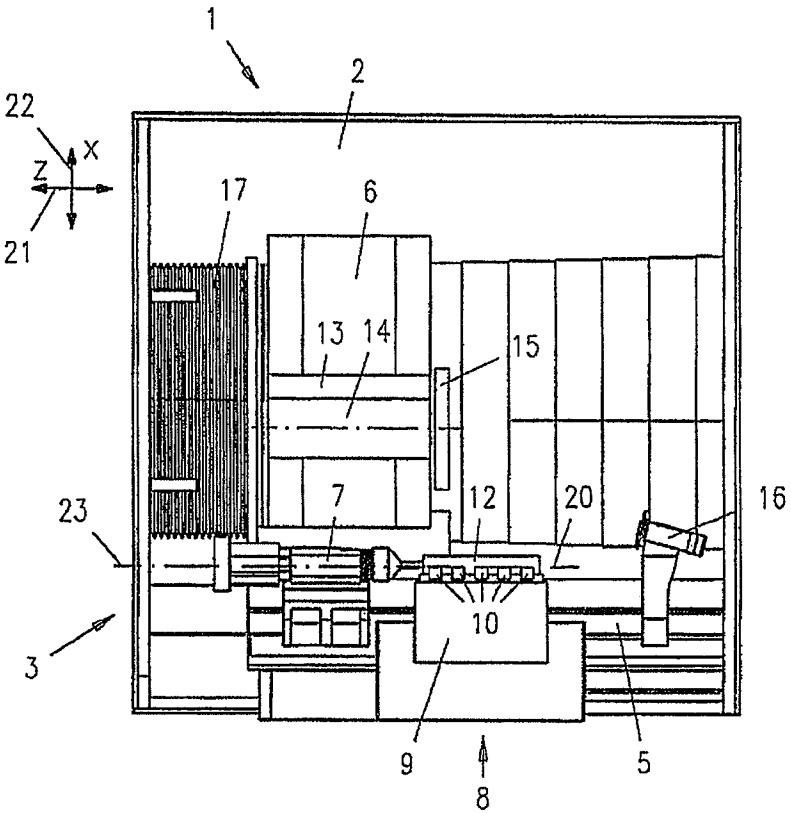
FIG. 1 is a schematic top view of a grinding machine in which the method for supporting the workpiece and the inventive steady according to the invention can be employed.

FIG. 1 is a schematic top view of a grinding machine 1 in which the method according to the invention is used and the shaft-like workpiece 12 is received in the steady 10 for performing this method. The grinding machine 1 has a machine bed 2 on which a grinding station 3 is arranged. On the machine bed 2, this grinding station 3 has a compound slide rest 6 that includes the two CNC-controlled traverse axes. The Z axis 21 runs parallel to the workpiece longitudinal axis 20 and the X axis 22 is oriented perpendicular to the Z axis 21, and thus to the workpiece longitudinal axis 20.

In accordance with FIG. 1, a grinding headstock 13 with feed slides that can be moved, CNC controlled toward the X axis 22, and that can be positioned toward the workpiece in the direction of the X axis 22, is attached to the compound slide rest 6. The grinding headstock 13 receives at least one grinding spindle 14 that, in its front area, receives at least one grinding wheel 15. The grinding wheel 15 and the grinding spindle 14 have a common center axis that is oriented axis-parallel to the center axis of the workpiece 12 during non-circular grinding. Arranged on the machine bed 2 in the front region, is a grinding table 5 that receives the support apparatus 8 for the shaft (workpiece 12) to be processed and that has inventive steadies 10 embodied, for example, as bearing blocks 18. The grinding table 5 also bears the workpiece headstock 7 with a chuck, the jaws of which are borne floating so that they are balanced perpendicular to the workpiece longitudinal axis 20, and so that they drive the workpiece about the C axis 23 (axis of rotation) stiffly and with no clearance radially.

There is also a cover 17 for the guide tracks of the Z axis 21 of the grinding station 3, and at least one dressing apparatus 16 for the grinding wheels 15 on the grinding table 5. A housing that surrounds the grinding machine 1 and other assemblies that are necessary for operating the grinding machine 1 are also present and familiar to one skilled in the art. They are not depicted in FIG. 1 for the sake of better clarity.

Figure 2:
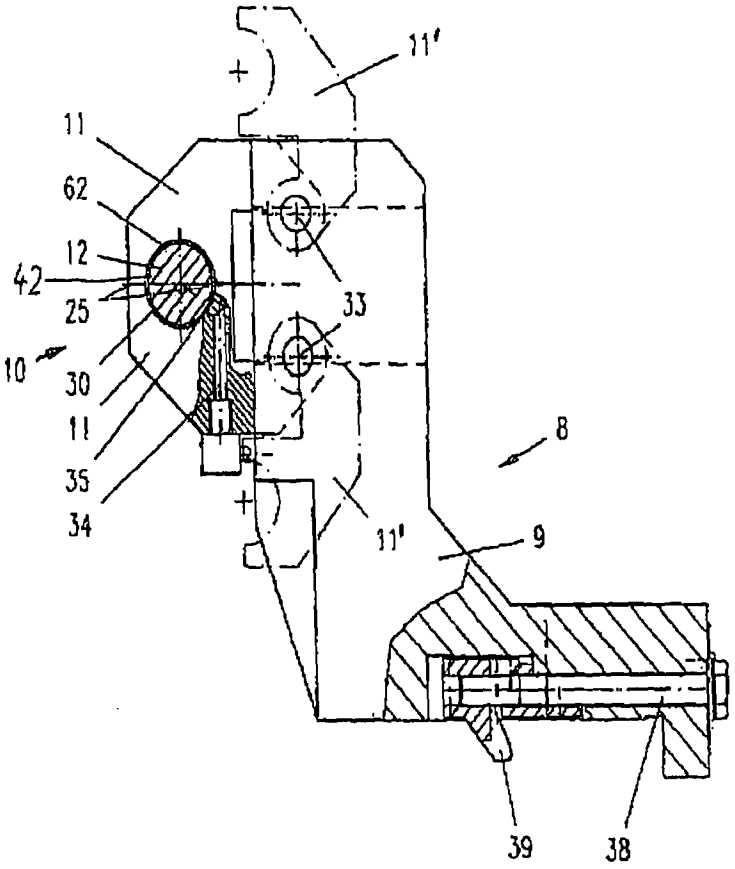
FIG. 2 is a simplified lateral section through a support apparatus having a divided steady with pivotable jaws for supporting shaft-like parts in accordance with the invention.

FIG. 2 is a schematic partial cut-away depiction of an exemplary embodiment of an inventive steady 10 in a support apparatus 8. The support apparatus 8 has a base body 9 on which the steady/steadies 10 are arranged and that can be securely mounted to the grinding table 5 by means of screws 38 and clamping claws 39. The steady 10 is divided in two at the dividing point 25, with two jaws 11 that are mounted on the base body 9 of the support apparatus 8 by means of associated pivot axes 33. Reference number 11' refers to the position of the jaws 11 when they are pivoted outward. For supporting shaft-like workpieces 12, during grinding the jaws 11 are pivoted in about the pivot axis 33, and this is preferably done by means of hydraulic drives (not shown here). The jaws 11 then completely surround the bearing point 42 to be supported of the workpiece 12 that can rotate about its longitudinal axis in the bore 30 formed by the two jaws 11 of the steady 10.

One of the jaws 11 of the inventive steady 10 is provided with a transverse bore 34 that opens via the opening 35 into the central bore 30 of the steady 10. The inventive pressure fluid can be conducted into the annular gap 62 formed between the workpiece 12 and the wall of the bore 30 through the opening 35 via additional bores 37 (not shown in FIG. 2) in the base body 9 and/or via other supply lines 36 (see FIG. 6). The dividing point 25 between the jaws 11 is machined with particular care and is constructed such that no gap through which the pressure fluid can enter or exit the dividing point 25 is formed when the jaws 11 are in the closed position. To this end, it is provided that at the dividing point 25 the two jaws 11 have planar, metal contact that, in conjunction with the contact pressure exerted on the jaws 11 by means of the preferably hydraulic adjusting forces, leads to the dividing point 25 being leak-proof.

The version described with reference to FIG. 2 is employed when, for instance, an assembled camshaft is produced, the bearing points 42 of which, after the cam is placed on the pipe, still have to be machined at the bearing points 42. The divided embodiment of the steadies 10 or bearing blocks 18 is also necessary when machining cast camshafts, because in this case, the bearing blocks 11 cannot be placed for the assembly until after the bearing points 42 have been completely machined.

Figure 3:
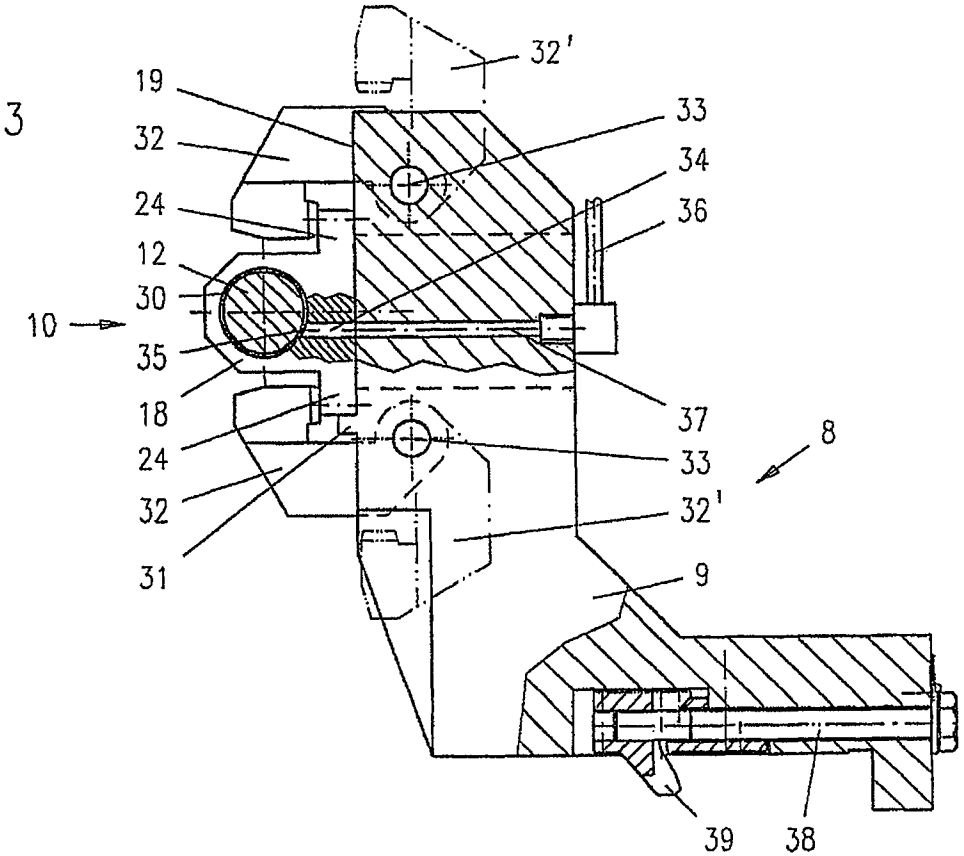
FIG. 3 is a simplified lateral section through a support apparatus having an integrated steady in accordance with the invention.

FIG. 3 depicts the clamping principle for the support apparatus 8 having another structure for the inventive steady 10. In this case, the steady 10, which is embodied as an undivided bearing block 18, is received in the support apparatus 8 at the same level 19 as the assembly level for the later installation. The bearing block is embodied with lateral extensions or tabs 24 that, provided with appropriate bores, can also facilitate later assembly. The bearing block 18 is fixed on the base body 9 of the support apparatus 8 using two tension levers 32 that can be pivoted hydraulically about the pivot axes 33. They are used at the location of the fastening screws that will be employed later when the workpiece 12 is installed in the interior of the motor. Provided on the base body 9 for precisely positioning the bearing blocks on the base body 9 of the support apparatus 8 are positioning means, in this case depicted as an example as a stop 31. Naturally, other positioning means may be used as well, such as centering sleeves or pins. The bearing of the tension levers 32 and their hydraulic activation are depicted only in a simplified manner here. Thus reference number 32' indicates the outwardly pivoted positions of the tension levers 32. The support apparatus 8 is attached to the grinding table 5 via the base body 9, for which purpose screws 38 and clamping claws 39 are provided.

As can be seen in FIG. 3, the bearing block 11 has a bore 30 for receiving the corresponding bearing point 42 of the workpiece 12 to be ground. It also has a transverse bore 34 that is arranged off center with respect to the bore 30, and the opening of which 35 opens into the bore 30. This transverse bore 34 is aligned with an additional bore 37 in the base body 9 of the support apparatus 8, which itself is connected to a supply line 36. Thus, a lubricant can be conducted from the supply line 36 into the bore 31 via an opening 35 in the transverse bore 34.

Figure 4:
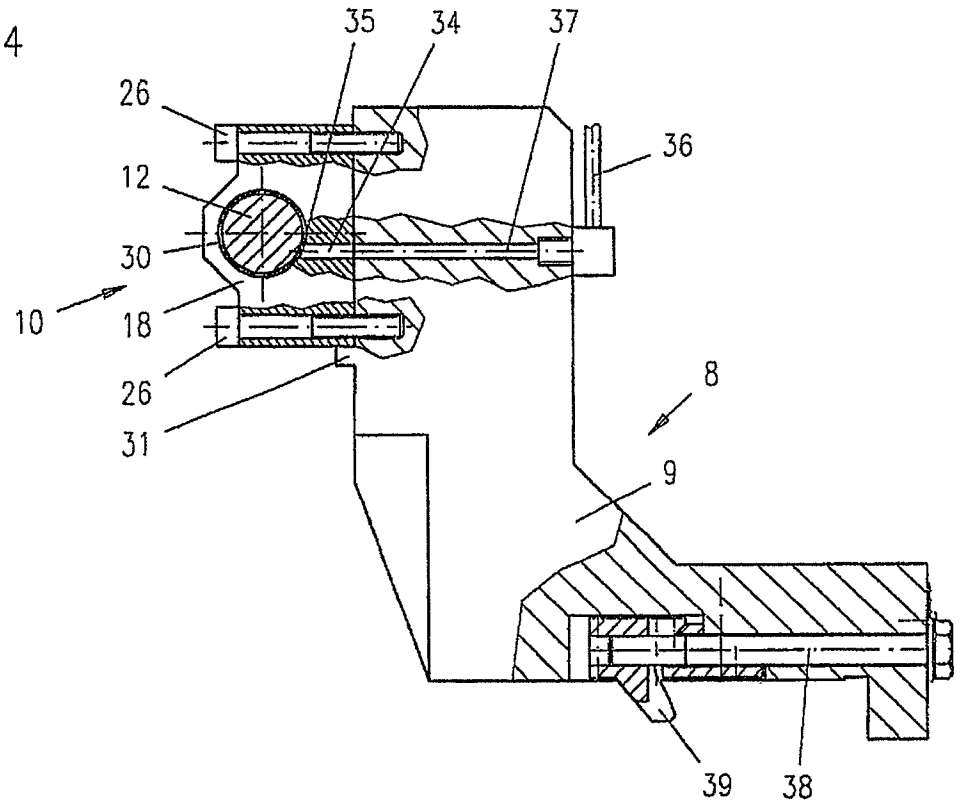
FIG. 4 is a simplified lateral section through a support apparatus having a steady embodied as a bearing block in accordance with the invention.

FIG. 4 depicts another undivided steady 10 in accordance with the invention that is embodied as a bearing block 18 like that in accordance with FIG. 3. This bearing block 18 is mounted to the base body 9 of the support apparatus 8 by means of screws 26. When being used, the bearing block 18 is pushed axially onto the supporting bearing point 42 or the bearing point 42 is inserted into the bore 30 of the bearing block 18.

Figure 5:
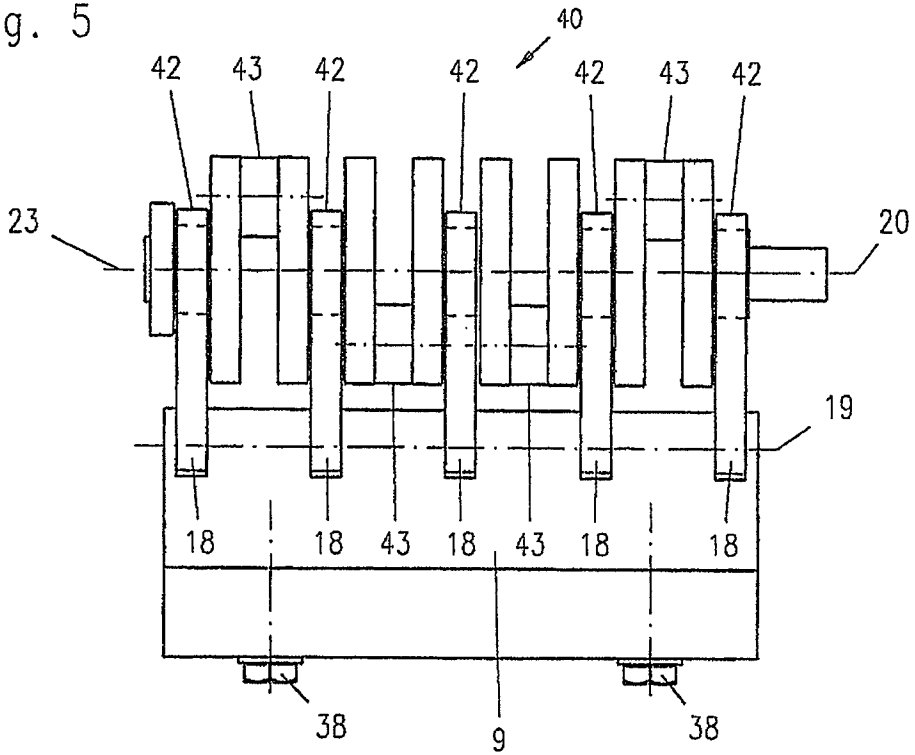
FIG. 5 is a schematic top view of a support apparatus having a plurality of support points in accordance with the invention for receiving a plurality of bearing points for a crankshaft.

FIG. 5 is a schematic depiction of the entire length of crankshaft 40 with steadies 10 embodied as bearing blocks 18, as support points in accordance with the invention. Since the crankshaft has five bearing points 42, there are also five clamping points for the bearing blocks 18 across the length of the support apparatus 8. Using these, the crankshaft 40 is supported for machining, for instance, for machining the connecting rod 43, across its entire length at its bearing points 42. The stiffness that is necessary for high precision grinding provides the support at the bearing points because the grinding forces are absorbed at the bearing points. Thus, during grinding all that is necessary is to floatingly clamp the end of the crankshaft 40 using the chuck for the workpiece headstock 7, and its drive in the C axis 23, which is CNC-controlled.

Figure 6:
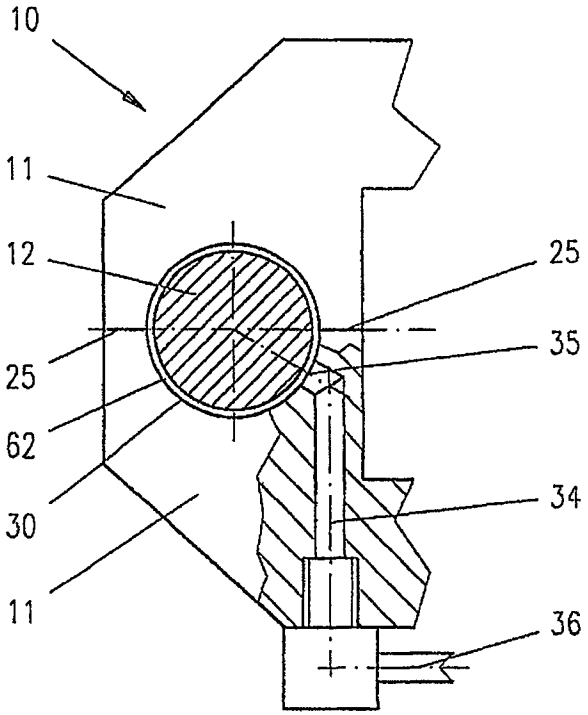
FIG. 6 is a schematic partial view of a divided steady in accordance with FIG. 2.

FIG. 6 depicts a divided steady 10 having two jaws 11, as they have already been described using FIG. 2, as a detail with segment 61 of the crankshaft 40 in the area of the bearing point 42. The steady 10 is provided with the bore 30 for receiving the bearing point 42. The diameter of the bore 30 is, for example, 25 mm and is finished with a diameter tolerance of approx. 15 μm. The transverse bore 34 opens into the bore 30 at the opening 35. The transverse bore 34 supplies the lubricant when the inventive method is being performed. In this case, as well, care should be taken that the dividing point 25 between the two jaws 11 of the steady 10 is absolutely leak-proof with respect to the lubricant that enters and acts as the pressure fluid. Direct metal-to-metal contact by the two jaws 33 at the dividing point 25 has proved itself for this purpose, the corresponding contact surfaces having to be machined with adequate precision. High precision is naturally also required for producing the two half shells that are embodied in the jaws 11, and that form the opening 30 for receiving the bearing point 42 of the workpiece 12 when the jaws 11 are inwardly pivoted, as depicted in FIG. 6.

When performing the method according to the invention, during the grinding cycle, lubricant is supplied to the support point 42 through the opening 35 of the transverse bore of the bearing block 18 acting as support 10. This lubricant enters into the annular gap 62 formed between the wall of the bore 30 and the bearing point 42 of the workpiece 12 and thus lubricates these components. Because it is under pressure, this lubricant escapes as lost oil through the annular gap 62 into the interior of the grinding machine 1. Therefore the same lubricant that is used as a cooling lubricant when grinding, is used for lubricating the bearing point. However, this grinding oil is specially filtered so that no grinding residues travel into the bearing point 42 of the workpiece 12.

The oil loss through the annular gap 62 also seals the bearing point 42 so that soiling particles do not penetrate into the bearing point 42 from outside. The bearing point 42 that is received in the bore 30 is approx. 40 to 60 μm smaller in diameter than the bore diameter. This results in a lubricant gap, corresponding to the annular gap 62, approx. 20 to 30 m in thickness, in which a hydrodynamic bearing is embodied during operation. This hydrodynamic bearing requires a minimum rotational speed for the rotating shaft/bearing point 42 for building up the lubricating film and in accordance with the invention is well below the grinding rotational speed when grinding the cam shape or the connecting rod. This grinding speed is generally in the range of approx. 50 to 500 $min^{-1}$.

In order to obtain good results when grinding workpieces, such as, for example, gear shafts, crankshafts, and camshafts, the method in accordance with the invention is performed as follows: When the shaft to be ground is started up from idle, the pressure of the lubricating oil supplied via the opening 35 to the bearing point 42 is set lower, and then as the workpiece 12 speeds up to the target rotational speed for grinding, the pressure is increased continuously. The pressure of the lubricating oil is increased as a function of the current rotational speed of the workpiece 12 until the target rotational speed, and thus the target pressure for grinding, have been attained. Pressure is controlled via special valves that are actuated via the CNC control.

This manner of proceeding is based on the knowledge in accordance with the invention that the radial stiffness of the bearing point increases when the supply pressure of the lubricating oil is increased. When the lubrication pressure is adjusted optimally at the target rotational speed for grinding, it is possible to attain trueness of the run for the bearing point 42 of 1 to 2 μm. Surprisingly, experiments have demonstrated that the inventive method is especially suitable for grinding gear shafts, crankshafts, and camshafts when the pressure in the hydrodynamic lubricating point/bearing point 42 is adapted to the rotational speed for grinding the workpiece 12. The optimum pressures are in the range of approx. 5 to 150 bar, depending on the rotational speed.

Excessive lubricating oil pressure and lubricating oil pressure that is too low do not provide satisfactory results. The lubricating film can tear when the lubricating oil pressure in the bearing point 42 is too low. When the lubricating oil pressure is set too high, the shaft is pressed against the side of the bore 30 that opposes the opening 35. In both cases the bearing would be damaged and it would not be possible to attain satisfactory grinding results.

The invention claimed is:

1. A method of supporting and dynamically centering a rotating workpiece during machining on a machine tool/grinding machine, comprising:

subjecting an axial region of the workpiece to a fluid pressure that acts radially on all sides of the workpiece along substantially the entire periphery of said sides of the workpiece at said axial region of the workpiece so as to effect a hydrodynamic supportively suspending the workpiece during machining thereof; and controlling the magnitude of said fluid pressure between a pre-specified minimum value and a pre-specified maximum value as a function of a current rotational speed of the workpiece.

2. A method according to claim 1, further comprising setting the fluid pressure at said minimum value when rotation of the workpiece is started up.

3. A method according to claim 1, further comprising increasing the fluid pressure as rotational speed of the workpiece increases.

4. A method according to claim 3, wherein said increasing the fluid pressure includes increasing the fluid pressure essentially linearly with the rotational speed.

5. A method according to claim 1, wherein the fluid pressure is adjusted by operation of a control device.

6. A method according to claim 5, further comprising determining and supplying the current rotational speed of the workpiece to the control device for the fluid pressure.

7. A method according to claim 6, wherein the control device detects the current fluid pressure and compares said current fluid pressure to a pre-specified rotational speed-dependent value.

8. A method of supporting and dynamically centering a rotating workpiece during machining on a machine tool/grinding machine, comprising:

subjecting an axial region of the workpiece to a fluid pressure that acts radially on all sides of the workpiece;

controlling the magnitude of said fluid pressure between a pre-specified minimum value and a pre-specified maximum value as a function of a current rotational speed of the workpiece; and increasing the fluid pressure as rotational seed of the workpiece increases, wherein said increasing the fluid pressure includes increasing the fluid pressure in a non-linear progression with the rotational speed, such that a rate of increase in pressure is steeper at higher rotational speed than at lower rotational speed.

9. A method of supporting and dynamically centering a rotating workpiece during machining on a machine tool/grinding machine, comprising:

subjecting an axial region of the workpiece to a fluid pressure that acts radially on all sides of the workpiece; and controlling the magnitude of said fluid pressure between a pre-specified minimum value and a pre-specified maximum value as a function of a current rotational speed of the workpiece;

wherein said controlling includes:

essentially attaining maximum value of the fluid pressure essentially at the machining rotational speed; and essentially maintaining said maximum value during machining.

* * * * *